United States Patent [19]

Duerig

[11] Patent Number: 4,935,068

[45] Date of Patent: Jun. 19, 1990

[54] METHOD OF TREATING A SAMPLE OF AN ALLOY

[75] Inventor: Thomas W. Duerig, Fremont, Calif.

[73] Assignee: Raychem Corporation, Menlo Park, Calif.

[21] Appl. No.: 300,409

[22] Filed: Jan. 23, 1989

[51] Int. Cl.[5] ..... C22F 1/00

[52] U.S. Cl. ..... 148/11.5 C; 148/11.5 N; 148/402; 420/902

[58] Field of Search ..... 148/11.5 C, 11.5 N, 148/402; 420/902

[56] References Cited

U.S. PATENT DOCUMENTS 4,490,112 12/1984 Tanaka et al. ..... 433/20

*Primary Examiner*—R. Dean

*Attorney, Agent, or Firm*—Simon J. Belcher; Herbert G. Burkard

[57] ABSTRACT

A method of treating a sample of an alloy which is capable of transforming between martensitic and austenitic phases, to render the alloy pseudoelastic, the method comprising:

(a) annealing the alloy at a temperature which is greater than the stress relaxation temperature ($T_{SR}$) of the alloy and less than the temperature at which the alloy is fully recrystallized ($T_x$); and (b) deforming the sample at a temperature which is greater than about the maximum temperature at which the alloy can be made to transform from its austenitic phase to its martensitic phase by the application of stress ($M_d$), and less than the stress relaxation temperature.

14 Claims, 3 Drawing Sheets

METHOD OF TREATING A SAMPLE OF AN ALLOY

BACKGROUND OF THE INVENTION

The invention relates to a method of treating a sample of an alloy which is capable of transforming between martensitic and austenitic phases, to render the alloy pseudoelastic.

Alloys which are capable of transforming between martensitic and austenitic phases are generally able to exhibit a shape memory effect. The transformation between phases may be caused by a change in temperature: for example, a shape memory alloy in the martensitic phase will begin to transform to the austenitic phase when its temperature increases to a temperature greater than $A_s$, and the transformation will be complete when the temperature is greater than $A_f$. The reverse transformation will begin when the temperature of the alloy is decreased to a temperature less than $M_s$, and will be complete when the temperature is less than $M_f$. The temperatures $M_s$, $M_f$, $A_s$ and $A_f$ define the thermal transformation hysteresis loop of a shape memory alloy. Commonly known alloys which are capable of transforming in this way are based on nickel-titanium, for example as disclosed in U.S. Pat. No. 3,753,700, U.S. Pat. No. 4,505,767 and U.S. Pat. No. 4,565,589, or on copper, for example as disclosed in U.S. Pat. No. 4,144,057 and U.S. Pat. No. 4,144,104.

It has been found that, under certain conditions, shape memory alloys are capable of being deformed elastically beyond what would normally be expected to be the elastic limit of metallic materials. This phenomenon is referred to as pseudoelasticity. As discussed in the paper presented by T. W. Duerig and G. R. Zadno at the International meeting of the Materials Research Society which took place in Tokyo in June 1988, certain alloys are capable of exhibiting pseudoelasticity of two types. The present invention is concerned with "non-linear pseudoelasticity" which arises in appropriately treated alloys while they are in their austenitic phase at a temperature which is greater than $M_s$ and less than $M_d$, where $M_d$ is the maximum temperature at which the transformation to the martensitic phase can be induced by the application of stress. An article formed from an alloy which exhibits non-linear pseudoelasticity can be deformed substantially reversibly by 8% or more. Non-linear pseudoelasticity is a shape memory effect involving transformation between martensitic and austenitic phaser of a shape memory alloy, but it need not involve a change in the temperature of the alloy. In contrast, "linear pseudoelasticity" is believed not to be accompanied by a phase change. An article formed from an alloy which exhibits linear pseudoelasticity can be deformed substantially only reversibly by about 4%.

Thus non-linear pseudoelasticity has the advantage that an article formed from an alloy which exhibits it can be deformed by significantly more than one formed from an alloy which exhibits linear pseudoelasticity.

The process which is generally used to confer non-linear pseudoelastic properties on a shape memory alloy involves annealing the alloy at a temperature above that at which the alloy has recovered to a significant degree but below that at which the alloy is fully recrystallized. For example, a sample of a shape memory alloy may be formed into a wire by a conventional cold-drawing technique. It may then be rendered pseudoelastic by annealing. As a result of the annealing step, the pseudoelastic properties of the alloy are characterized: for present purposes, reference will be made to the maximum elastic strain, which term denotes the strain which is imparted to a sample at the elastic limit and can be recovered substantially elastically, and to the effective elastic modulus, which term denotes the ratio of the applied stress to the imparted strain.

If it is desired to provide a sample in a configuration which is different from that in which it is drawn or otherwise formed, it is deformed and held in the deformed configuration during the annealing step. The deformation of the sample may take place before the annealing step is started or during the annealing step, the annealing step ensuring that the deformed sample has pseudoelastic properties. The configuration of a sample which has been annealed may be changed by heating the sample again to the annealing temperature and holding it in the deformed configuration at that temperature.

It is inconvenient to deform a sample of a shape memory alloy while it is annealed since, for example, it renders continuous annealing of a shape memory wire difficult and impractical. However, it is known that if the sample is deformed so as to change its configuration after it has cooled after the annealing step, the pseudoelastic properties of the alloy characterized as a result of the annealing step are affected adversely and, in some cases, destroyed.

SUMMARY OF THE INVENTION

According to the present invention, it has been found that a sample of a shape memory alloy may be rendered pseudoelastic by annealing, and then be deformed at a temperature which is less than the annealing temperature without affecting the pseudoelastic properties to a significant extent, provided that the deformation takes place at a temperature which is greater than about $M_d$.

Accordingly, the invention provides a method of treating a sample of an alloy which is capable of transforming between martensitic and austenitic phases, to render the alloy pseudoelastic, the method comprising:

(a) annealing the alloy at a temperature which is greater than the stress relaxation temperature ($T_{SR}$) of the alloy and less than the temperature at which the alloy is fully recrystallized ($T_x$); and (b) deforming the sample at a temperature which is greater than about the maximum temperature at which the alloy can be made to transform from its austenitic phase to its martensitic phase by the application of stress ($M_d$), and less than the stress relaxation temperature.

DESCRIPTION OF THE INVENTION

As used herein, the term "stress relaxation temperature ($T_{SR}$)" of a shape memory alloy is the temperature above which the stress exerted by a sample of the alloy tends to relax significantly when the sample is maintained under a constant strain. Stress relaxation can be monitored by maintaining the sample under a constant strain and measuring the change in stress in the sample, for example by means of a load cell. The stress relaxation temperature is the temperature above which the stress relaxation of an alloy, maintained under a 4% strain for one hour, exceeds 5%.

The alloy is annealed until pseudoelastic properties are observed. This may be monitored by measuring the permanent set after deforming a sample of the alloy by 8%, as a function of the annealing conditions: it is found that supplying too little heat to the sample so that its temperature is below TSR does not bring about the reduction of the permanent set which is apparent if the alloy is rendered pseudoelastic, and that supplying too much heat so that the alloy recrystallizes causes the permanent set to increase, indicating a loss of pseudoelastic properties. It is generally desired that there be less than about 0.8% permanent set after 8% deformation. In the case of a sample in the form of a wire, annealing it for from about 90 to about 150 seconds is preferred, especially about 120 seconds.

While it is known that deforming a sample of a pseudoelastic shape memory alloy can affect the pseudoelastic properties of the alloy adversely, it has been found in accordance with the present invention that, if the deformation is carried out after the alloy has been cooled after the annealing step, deformation can take place without affecting the pseudoelastic properties to a significant extent at a temperature which is less than $T_{SR}$, and therefore less than the annealing temperature, provided that the deformation takes place at a temperature which is greater than about $M_d$.

$M_d$ of an alloy can be determined by deforming samples of the alloy to an 8% strain at a number of different temperature, and then removing the deforming load; for each sample, the stress-strain plot will have the form of a hysteresis loop, with plateaus on both loading and unloading over which the stress remains substantially constant over a range of strain. $M_d$ is the temperature at which the plateau stress on loading becomes approximately constant on increasing temperature. The deformation step of the method is preferably carried out at a temperature which is greater than $M_d$ in order to minimize the amount of springback when the deformation is stopped. However, the deformation may take place at a temperature slightly below $M_d$ if it is not necessary to minimize the amount of springback. Thus the deformation step is carried out at a temperature which is greater than about $M_d$, which for some applications, may be greater than 15° C. below $M_d$, but preferably is greater than 10° C. below $M_d$, and more preferably is greater than $M_d$.

Significant advantages arise from deforming the sample in this temperature range. For example, the method of the present invention allows the characterization of pseudoelastic properties and the selection of the configuration of a sample of a shape memory alloy to be separated. This in turn allows greater control to be placed on each of these steps than is possible when the sample is deformed at the annealing temperature as in previously used methods. Indeed, heating a sample of an alloy which has been deformed to the annealing temperature in order to impart a desired configuration to it is likely to change the pseudoelastic properties imparted to the alloy by the first anneal step, which can be undesirable from the point of view of controlling the pseudoelastic properties of the final article.

Furthermore, significant advantages arise from the different natures of the annealing and deformation steps of the method: the annealing step generally involves maintaining the sample at the relevant temperature for a longer period than does the deformation step, but the sample can be in motion during the annealing step allowing continuous processing, whereas in the deformation step, it is generally necessary that the sample be maintained in a forming fixture such as a die for an extended period, for example for as much as two minutes or even more. Thus, compared with the previously used method in which a sample was held in a deformed configuration during the annealing step, the method of the invention allows significant improvements to be made in the time taken to perform the annealing step, by virtue of the ability to perform the step continuously. For example, when the sample is in the form of a wire, it may be passed continuously through a furnace which is maintained at the annealing temperature, the speed with which it passes through the furnace being selected to expose the wire to the annealing conditions for an appropriate period to confer desired pseudoelastic properties on the wire. A desired configuration can then be imparted to the wire in a subsequent deformation step at a temperature between $M_d$ and $T_{SR}$. However, compared with the deformation step in previously used methods, the deformation step can be carried out over a shorter period, for example less than 20 seconds, preferably less than 10 seconds, especially about 5 seconds.

Another advantage of carrying out the deformation step below the annealing temperature is that the necessary heat can be supplied to the sample more conveniently than is the case if the sample is heated to the annealing temperature. For many alloys, heating to a temperature between $M_d$ and $T_{SR}$ can be achieved conveniently by submerging the sample in a quantity of a liquid, such as an oil.

Since the annealing step can be carried out continuously on sufficient shape memory alloy subsequently to produce a plurality of articles, and the pseudoelastic properties of the alloy in each of those articles are characterized by that annealing step, the present method ensures that the pseudoelastic properties need only be measured a single time for all of the articles made from a batch of the annealed alloy. This is in contrast to the previously used method in which articles are annealed individually, so that the pseudoelastic properties of the articles generally must be measured individually.

In addition to preserving the pseudoelastic properties of an annealed sample of a shape memory alloy, deformation at a temperature below $T_{SR}$ to change the configuration of the sample has the advantage that, below that temperature, the sample will not tend to lose the configuration imparted to it during the annealing step unless steps are taken to deform it, for example by means of a die. This allows the configuration of only selected portions of a sample to be changed as desired while the configuration of the remainder of the sample remains substantially unaffected by the deformation step. For example, when the sample is in the form of a wire, it may be annealed in a straight configuration. The configuration of selected portions of the wire may then be changed by deformation, for example around forming pins, at a temperature between about $M_d$ and $T_{SR}$, leaving the remainder of the wire straight, without any need to support it.

The nature of the deformation imparted to the sample will depend on the configuration of the sample after the annealing step and the final desired configuration. For example, the sample may be deformed by stretching it uniaxially, or in a bending mode, or in a torsion mode, or in a combination of these ways. Bending and torsional deformations may be imparted to the sample by means of suitable forming fixtures such as an array of pegs around which the sample is deformed, or a suitable die, which may comprise two or more parts between which the sample is pressed. Preferably the forming fixture is heated to a temperature between $M_d$ and $T_{SR}$; this may be achieved, for example, by immersing the fixture in a quantity of fluid, or by internal heating means, which could be in the form of one or more electrical heating elements.

At least before the deformation step, it is preferred that the sample has a constant cross-section, for example having the form of a tape, bar, sheet, or more preferably a wire. A constant cross-section is preferred since it generally facilitates continuous operation of the annealing step, giving rise to the advantages discussed above. Furthermore, certain samples having constant cross-sections can be stored on reels between the annealing and deformation steps of the method. The method of the invention therefore allows long lengths of a shape memory alloy, which has been rendered pseudoelastic, to be supplied in a convenient form on a reel for subsequent deformation to a desired configuration under conditions of heat which do not affect significantly the pseudoelastic properties.

When the sample is in the form of a wire, it may have a non-round cross-section, for example oval, or polygonal such as rectangular or square, or Y- or T- or X-shaped. Preferably, the wire has a round cross-section.

The sample may be deformed up to the ductility limit of the annealed alloy. For example, in the case of an annealed nickel-titanium binary alloy, up to about 30% deformation is possible. However, if the alloy is deformed by a relatively large amount, the risk of affecting the pseudoelastic properties of the alloy increases. Deformation of the above-mentioned binary alloy by up to about 15% is possible without affecting its pseudoelastic properties significantly other than to increase the elastic limit slightly and to decrease the effective elastic modulus slightly. The extent of deformation is calculated in conventional fashion, for example in terms of axial displacement for uniaxial stretching, and outer fiber strain analysis for bending or tension.

It is found that some of the deformation imparted to the sample is lost immediately after the deformation as a result of elastic springback. The amount of springback to be accommodated is generally acceptably small provided that the deformation takes place at a temperature which is greater than about $M_d$. The amount of springback can be reduced yet further by deforming the sample at a temperature towards $T_{SR}$ rather than towards $M_d$. For this reason, it can be preferable that the sample is deformed at a temperature which is greater than about 0.5 $(T_{SR}+M_d)$, more preferably greater than about $(0.75T_{SR}+0.25\ M_d)$. Preferably the springback is taken into account when the sample is deformed, by deforming the sample to a slightly larger extent than is required after deformation.

The alloy will be selected according to the desired pseudoelastic properties, which will include the temperature range ($A_s$ to $M_d$, preferably $A_f$ to $M_d$, of the alloy) over which those properties are available. It will generally be a nickel-titanium based alloy, which may include additional elements which might affect the pseudoelastic properties. For example, the alloy may be a binary alloy consisting essentially of nickel and titanium, for example 50.8 atomic percent nickel and 49.2 atomic percent titanium, or it may include a quantity of a third element such as vanadium, chromium or iron. Alloys consisting essentially of nickel, titanium and vanadium, such as those disclosed in U.S. Pat. No. 4,505,767, are particularly preferred for some applications, especially medical applications. Copper based alloys may also be used, for example alloys consisting essentially of copper, aluminum and nickel, copper aluminum and zinc, and copper and zinc.

An article comprising a sample of an alloy which has been treated by the method of the invention can be used in many of the applications in which articles comprising shape memory alloy components rendered pseudoelastic by other methods have previously been used. For the reasons set out above, the present method is particularly well suited to making articles which include a pseudoelastic shape memory alloy wire. The wire may be deformed from a straight configuration to one in which at least a portion of the wire appears to have an undulated configuration when viewed in side elevation. The undulations may be such that they can be fitted in a single plane, so that the wire has a generally sinusoidal configuration, or they may be such that the wire has a helical configuration.

The method of the invention may thus be used to make pseudoelastic helical springs. The use of the method to make pseudoelastic helical springs has the advantage that spring winding equipment of a generally conventional type can be used. Such equipment cannot readily operate to form springs at a temperature between $T_{SR}$ and $T_x$ of a shape memory alloy, but they can generally be adapted to operate to form springs at a temperature between $M_d$ and $T_{SR}$ of the alloy.

The method may be used to make interconnection wires for use in the assembly and method invented by Stephen H. Diaz, which are the subjects of the U.S. patent application filed on Jan. 13, 1989 and entitled "Assembly of Electrically Interconnected Articles" (Ser. No. 297154). The subject matter disclosed in that application is incorporated in the present application by this reference.

The method may be used to make medical devices, such as orthodontic wires, guide wires for catheters, bone staples, hooks for insertion in tubular apertures in bones for anchoring to the bones, and hooks for surgical localization of tumors in mammary glands such as those sold by Namic Inc. under the trademark Mammalok. U.S. Pat. No. 4,665,906 discloses medical devices which incorporate pseudoelastic shape memory alloy components. The subject matter disclosed in that document is incorporated in the present application by this reference.

EXAMPLES

An alloy consisting of 50.8 atomic percent nickel and 49.2 atomic percent titanium having a recrystallization temperature of about 600° C., was formed into a wire having a circular cross-section by cold-working. The diameter of the wire was about 1.0 mm.

A length of the wire was heat-treated in a salt bath at 500° C. for 120 seconds. The wire was removed from the bath and allowed to cool to room temperature.

The wire was placed in a tensile tester. The wire was placed under an increasing load until a strain of 8% was attained. The load was then removed.

Figure 1:
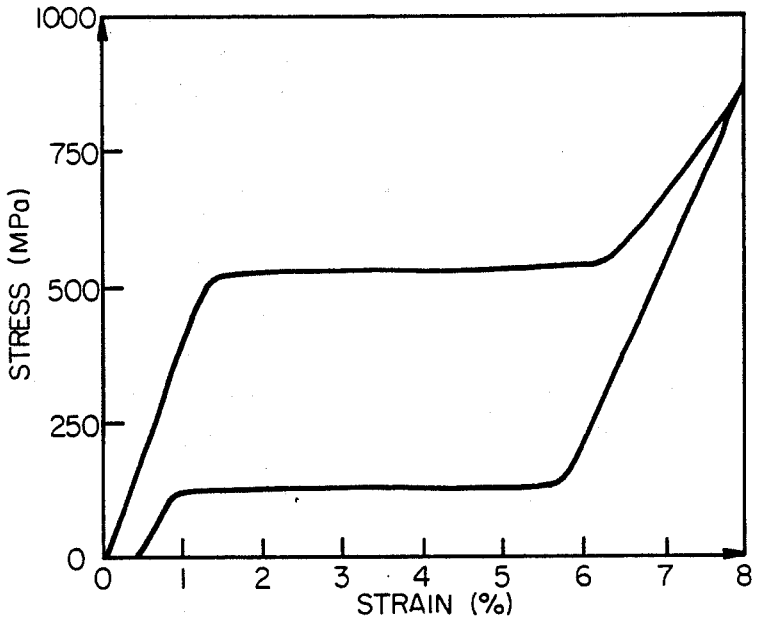
FIG. 1 is a graph of stress versus strain for a pseudoelastic wire.

The variation of stress with strain is depicted in FIG. 1. The upper line depicts the behavior on loading and the lower line depicts the behavior on unloading.

Figure 2:
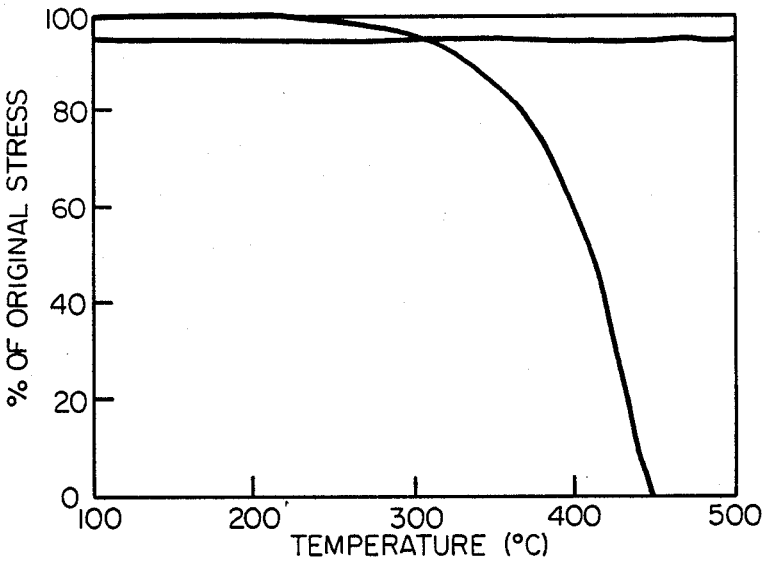
FIG. 2 shows how the plateau stress on axially loading a pseudoelastic wire depends on temperature.

$M_d$ of the alloy was determined by performing this procedure on samples of the wire over a range of temperatures, and monitoring the change in the stress of the loading plateau with temperature. $M_d$ is the temperature at which the plateau stress on loading becomes approximately constant with increasing temperature. FIG. 2 shows how the plateau stress varied with temperature. From FIG. 2, it can be seen that $M_d$ has a value of 160° C.

Figure 3:
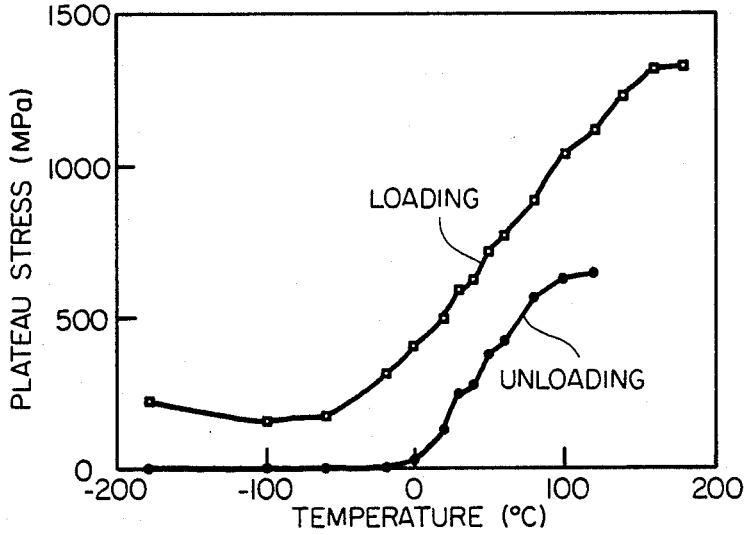
FIG. 3 shows how the stress relaxation in a pseudoelastic wire maintained under constant strain depends on temperature.

The stress relaxation temperature ($T_{SR}$) of the alloy was determined using a tensile tester by maintaining a sample of the wire under a strain of 4% for one hour and measuring the change in stress. This procedure was performed on samples of the wire over a range of temperatures. $T_{SR}$ is the temperature at which the stress relaxes by about 5%. FIG. 3 shows how the stress varied with temperature. From FIG. 3, it can be seen that $T_{SR}$ has a value of 310° C.

1. COMPARATIVE EXAMPLE

Figure 4:
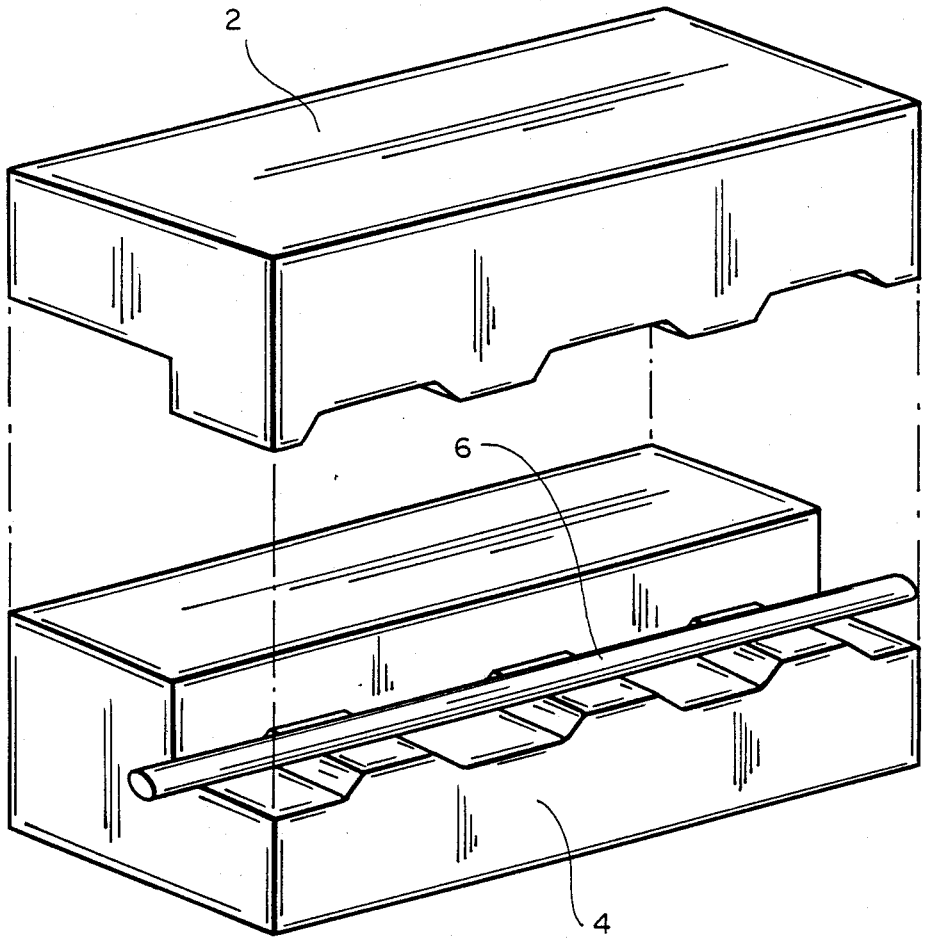
FIG. 4 is an isometric view of a die for imparting a generally wave-like configuration to a pseudoelastic wire.

A length of the wire was fitted into the forming fixture illustrated in FIG. 4. The fixture is a die in two parts 2, 4 which can be pressed together with the wire 6 between them. The mating surfaces of the parts each have a series of cooperating grooves and ridges which impart a generally wave-like configuration having a number of undulations to the wire. The outer fiber strain imparted to the wire by the die was about 12.5%.

The wire was heat-treated in a salt bath at 500° C. for 120 seconds while in the forming fixture. The wire was removed from the bath and allowed to cool to room temperature. It was then removed from the forming fixture. The wire then experienced about 4% springback.

The wire was placed under a gradually increasing load and the resulting change in wavelength of the undulations was measured. The load was increased until the wavelength had increased by about 10%. The load was then gradually reduced.

Figure 5:
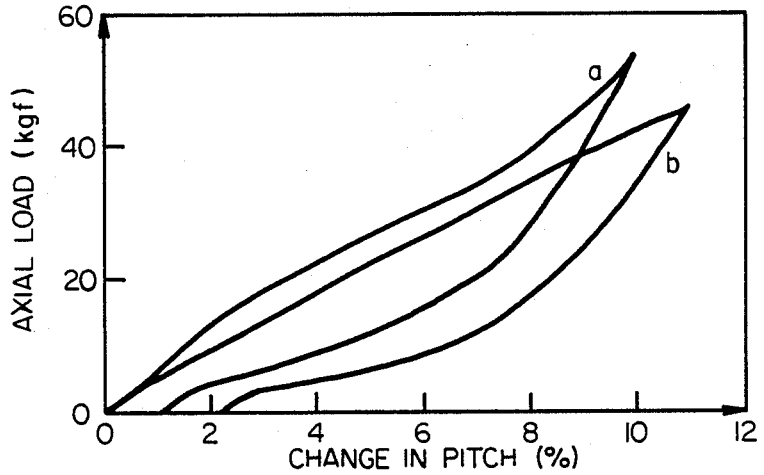
FIG. 5 is a graph showing how the pitch of pseudoelastic wires formed using the die shown in FIG. 4 changes when an axial load is applied to the wires.

The variation of load with wavelength is depicted by curve (a) in FIG. 5. The upper line depicts the behavior on loading and the lower line depicts the behavior on unloading.

2. EXAMPLE

A length of wire which had been annealed in the manner described above in Example 1 was heated to about 180° C. and fitted into the forming fixture illustrated in FIG. 2 which was itself heated to about 180° C. The wire remained in the fixture for about 10 seconds and was then removed. It was then placed under a gradually increasing load in the manner described above until the wavelength had increased by about 11%. The load was then gradually reduced.

The variation of load with wavelength is depicted by curve (b) in FIG. 5.

The curves depicted in FIG. 5 differ from that depicted in FIG. 1 because the deformation involves a bending deformation instead of, or in addition to, a stretching deformation. It can be seen that the pseudoelastic properties of the wire formed using the method of the invention are very similar to those properties of a wire which was deformed at the annealing temperature, notwithstanding the fact that the deformation took place at a temperature below the annealing temperature.

What is claimed is:

1. A method of treating a sample of an alloy which is capable of transforming between martensitic and austenitic phases, to render the alloy pseudoelastic, the method comprising:
   (a) annealing the alloy at a temperature which is greater than the stress relaxation temperature ($T_{SR}$) of the alloy and less than the temperature at which the alloy is fully recrystallized ($T_x$); and
   (b) deforming the sample at a temperature which is greater than about the maximum temperature at which the alloy can be made to transform from its austenitic phase to its martensitic phase by the application of stress ($M_d$), and less than the stress relaxation temperature.

2. A method as claimed in claim 1, in which the sample is deformed by stretching it uniaxially.

3. A method as claimed in claim 1, in which the sample is deformed in a bending mode.

4. A method as claimed in claim 1, in which the sample is deformed in a torsion mode.

5. A method as claimed in claim 1, in which the amount by which the sample is deformed is less than about 15%.

6. A method as claimed in claim 1, in which the sample is deformed while submerged in a quantity of liquid which is heated to a temperature between $M_d$ and $T_{SR}$.

7. A method as claimed in claim 1., in which the sample is deformed in a forming fixture which is heated to a temperature between $M_d$ and $T_{SR}$.

8. A method as claimed in claim 1,, in which the sample is deformed at a temperature which is greater than about 0.5 ($T_{SR}+M_d$).

9. A method as claimed in claim 1, in which the sample is in the form of a wire.

10. A method as claimed in claim 9, in which at least a portion of the wire appear to have an undulated configuration when viewed in side elevation.

11. A method as claimed in claim 10, in which the undulations can be fitted substantially in a single plane, so that the wire is formed with a generally sinusoidal configuration.

12. A method as claimed in claim 10, in which at least a portion of the wire has a helical configuration.

13. A method as claimed in claim 1, in which the alloy is a nickel-titanium based alloy.

14. An article comprising a sample of an alloy, which has been treated by a method as claimed in claim 1.

* * * * *